US007036259B2

(12) United States Patent
Beretta

(10) Patent No.: US 7,036,259 B2
(45) Date of Patent: May 2, 2006

(54) CASING FOR FIREARMS

(75) Inventor: Ugo Gussalli Beretta, Gardone Val Trompia (IT)

(73) Assignee: Fabbrica d'Armi Pietro Beretta S.p.A., Brescia (IT)

( * ) Notice: Subject to any disclaimer, the term of this patent is extended or adjusted under 35 U.S.C. 154(b) by 362 days.

(21) Appl. No.: 10/414,978

(22) Filed: Apr. 16, 2003

(65) Prior Publication Data

US 2003/0208942 A1 Nov. 13, 2003

(30) Foreign Application Priority Data

Apr. 22, 2002 (IT) ..... MI2002A0856

(51) Int. Cl.
*F41A 24/00* (2006.01)

(52) U.S. Cl. ..... 42/75.02

(58) Field of Classification Search ..... 42/75.01, 42/75.02

See application file for complete search history.

(56) References Cited

U.S. PATENT DOCUMENTS

| | | | | | |
|---|---|---|---|---|---|
| 3,849,925 | A | * | 11/1974 | Mayer | 42/75.02 |
| 3,877,167 | A | * | 4/1975 | Keppeler | 42/75.02 |
| 4,095,507 | A | | 6/1978 | Close | |
| 4,402,152 | A | * | 9/1983 | Casull | 42/16 |
| 4,685,235 | A | * | 8/1987 | Bunning et al. | 42/75.02 |
| 4,765,224 | A | * | 8/1988 | Morris | 89/191.01 |
| 4,893,426 | A | * | 1/1990 | Bixler | 42/75.01 |
| 5,412,895 | A | * | 5/1995 | Krieger | 42/75.02 |
| 5,706,599 | A | * | 1/1998 | Knight | 42/75.02 |
| 5,768,815 | A | * | 6/1998 | Casull | 42/46 |
| 5,987,797 | A | * | 11/1999 | Dustin | 42/75.02 |
| 6,250,198 | B1 | * | 6/2001 | Vendetti et al. | 89/44.02 |
| 6,273,080 | B1 | * | 8/2001 | Sullivan, Jr. | 124/84 |
| 6,295,751 | B1 | * | 10/2001 | Piwonski | 42/1.15 |
| 6,301,817 | B1 | | 10/2001 | Hogue et al. | |
| 6,499,245 | B1 | * | 12/2002 | Swan | 42/71.01 |
| 6,655,372 | B1 | * | 12/2003 | Field et al. | 124/83 |
| 6,662,797 | B1 | * | 12/2003 | Freeman et al. | 124/83 |
| 6,668,815 | B1 | * | 12/2003 | Fernandez | 124/83 |
| 6,671,990 | B1 | * | 1/2004 | Booth | 42/75.01 |
| 2002/0073595 | A1 | * | 6/2002 | Di Pietro | 42/77 |
| 2002/0104523 | A1 | * | 8/2002 | Juan | 124/56 |
| 2003/0182838 | A1 | * | 10/2003 | Kessler | 42/79 |

FOREIGN PATENT DOCUMENTS

| | | | |
|---|---|---|---|
| DE | 2157420 | * | 3/1973 |
| DK | 720620 | * | 12/1954 |
| EP | 0 903 556 | | 3/1999 |
| FR | 2 231 934 | | 12/1994 |
| GB | 704837 | * | 3/1954 |
| SE | 86389 | * | 10/1955 |

OTHER PUBLICATIONS

EP Search Report.

* cited by examiner

*Primary Examiner*—Michael J. Carone
*Assistant Examiner*—Troy Chambers
(74) *Attorney, Agent, or Firm*—James V. Costigan

(57) ABSTRACT

A casing for firearms, comprising a metal sleeve (15) on which is stably applied, through attachment means, a barrel (12), an inner element (14) made from polymeric material for the anchoring of said sleeve (15) and an outer shell (13) made from polymeric material, is realised through successive overmouldings in sequence of the inner element (14) on the sleeve (15) to form a sleeve—inner element group (11) and then of the shell (13) on the group (11) to form the casing (10).

15 Claims, 6 Drawing Sheets

CASING FOR FIREARMS

The present invention refers to a casing for firearms (in particular for a semi-automatic rifle).

A casing for a firearm constitutes the front structure to which a metal barrel and auxiliary devices are fixed.

During firing steps, the casing undergoes substantial thermal stresses, following the transfer of heat from the barrel, and mechanical stresses, due to the fast dynamic of the firearm and the consequent knocks due to the breech-block.

Currently, casings for firearms are made from metal or in any case comprise a high number of metal components, suitable for ensuring the necessary resistance to thermal and mechanical stresses.

This solution implies the realisation of an expensive firearm of substantial weight.

Greater use of polymeric materials for the realisation of the casing would undoubtedly allow costs and weight to be substantially reduced, but it poses problems of thermal and mechanical resistance, in particular in the area which the barrel is fixed.

The purpose of the present invention is that of realising a casing for firearms of reduced weight.

Another purpose of the present invention is that of realising a casing which is resistant and reliable in particular in the area which the barrel is fixed.

Another purpose of the present invention is that of realising a casing for firearms which is particularly simple and functional, with contained costs.

These purposes according to the present invention are accomplished by realising a casing for firearms as outlined in claim 1.

Further characteristics are foreseen in the dependent claims.

The characteristics and advantages of a casing for firearms according to the present invention shall become clearer from the following description, given as an example and not for limiting purposes, referring to the attached schematic drawings, in which.

Figure 1:
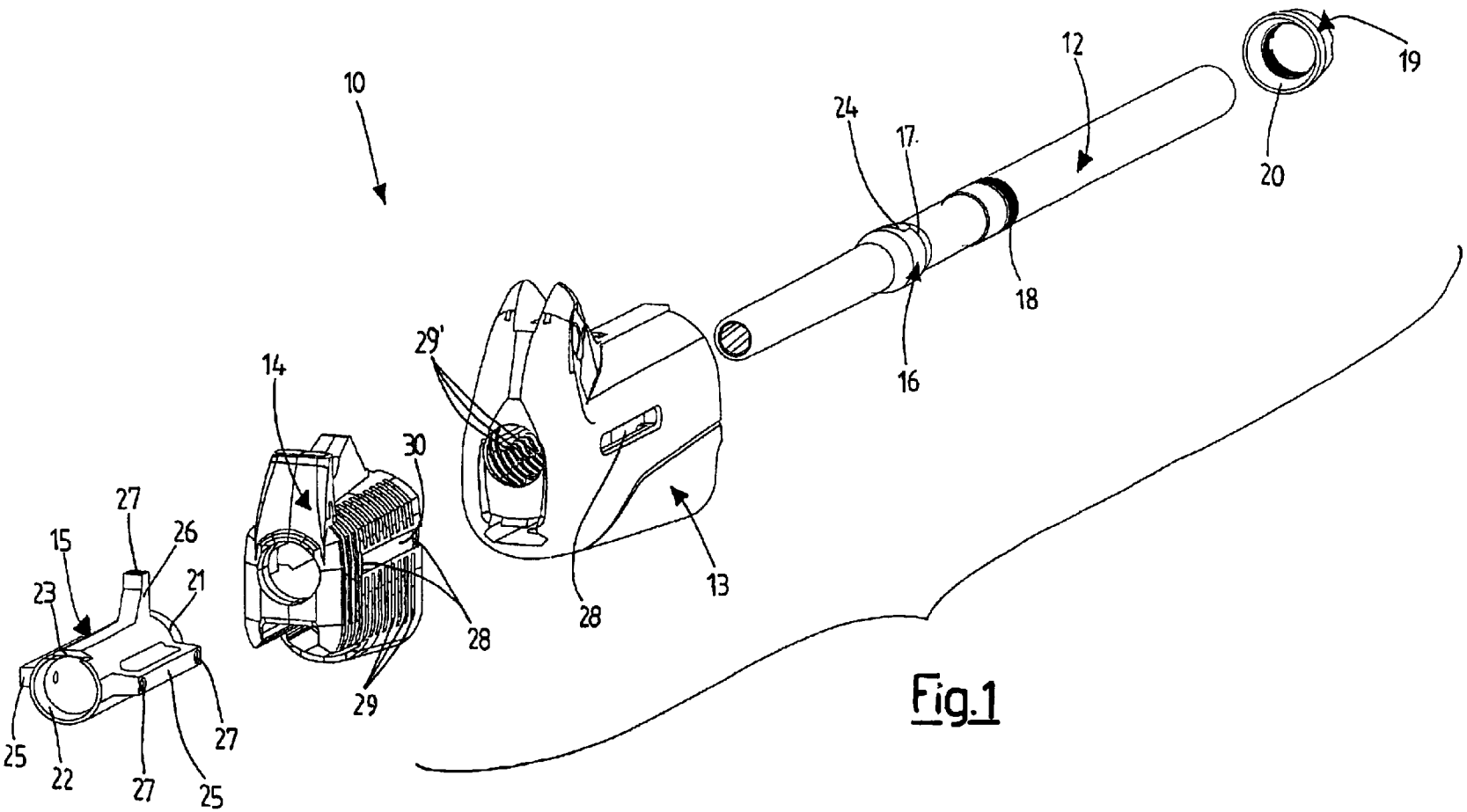
FIG. 1 is an exploded view of a casing for firearms, object of the present invention, and of a metal barrel fixed to it.

Hereafter, specific reference shall be made to a rifle, although that which is object of the invention can generally be applied to other firearms, including side-by-side, semi-automatic, rifled and military ones, etc. Moreover, given that the invention is intended for experts in the field of firearms, it is omitted the detailed description of the structure and operation of a firearm, in particular of a rifle like the one described. Reference is made only to the functions of the firearm parts involved in the technical problem forming the basis of the invention.

With reference to the figures, a casing for firearms is shown, wholly indicated with 10, to which a metal barrel 12 is fixed.

The casing comprises an outer shell 13 substantially shaped according to the final shape of the casing 10 and shown in the figures only in its front part. The casing also comprises an inner element 14, made from polymeric material with high thermal and structural resistance, as well as a sleeve 15, for example made from aluminium suitable for establishing the attachment with the barrel 12.

As shown in the exploded view of FIG. 1, the barrel 12, for example of the internally rifled type, is equipped on its outer surface with an abutment ring 16, equipped with a frusto-conical guide slide 17, and with a threaded portion 18 for engagement with a threaded attachment ring nut 19, which constitute the attachment means with which the barrel 12 is fixed to the sleeve 15.

Figure 5:
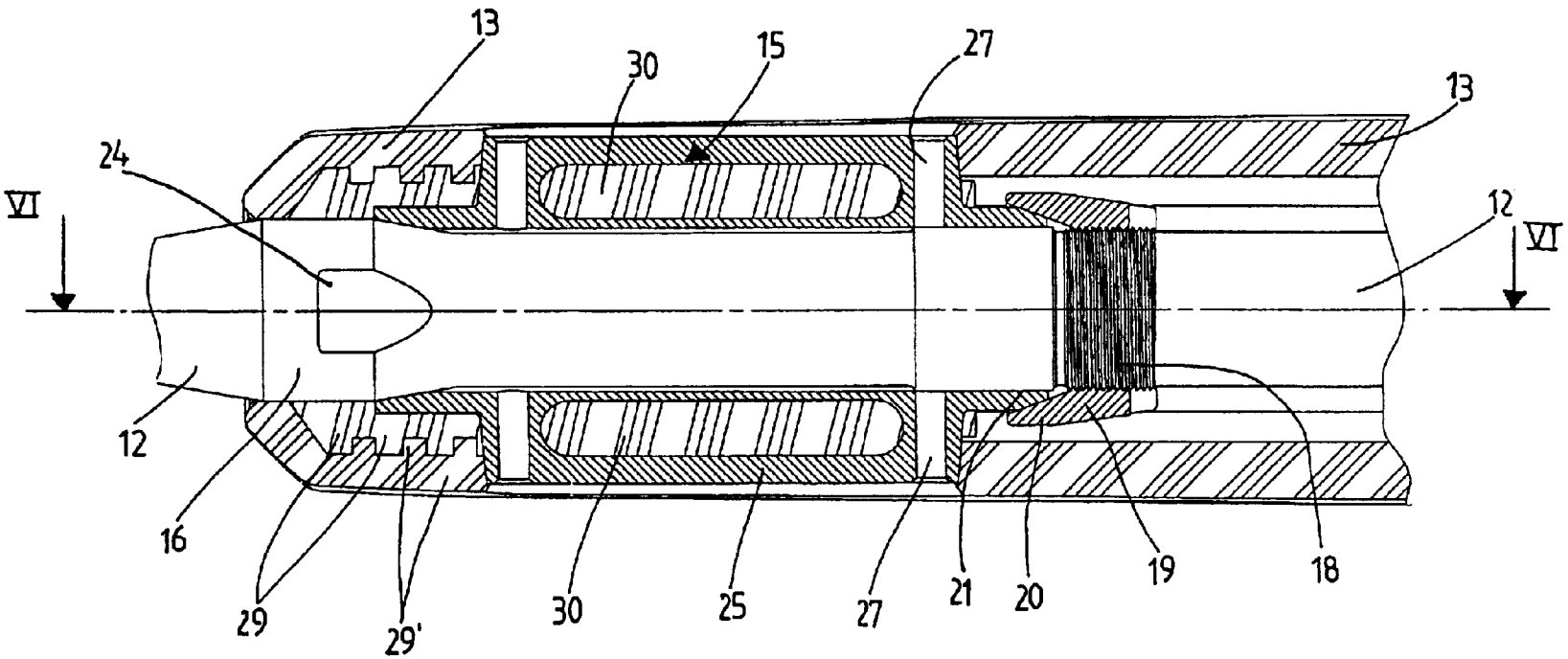
FIG. 5 is a view of the casing of FIG. 4 onto which the barrel is mounted, partially in section according to the line V—V.
Figure 6:
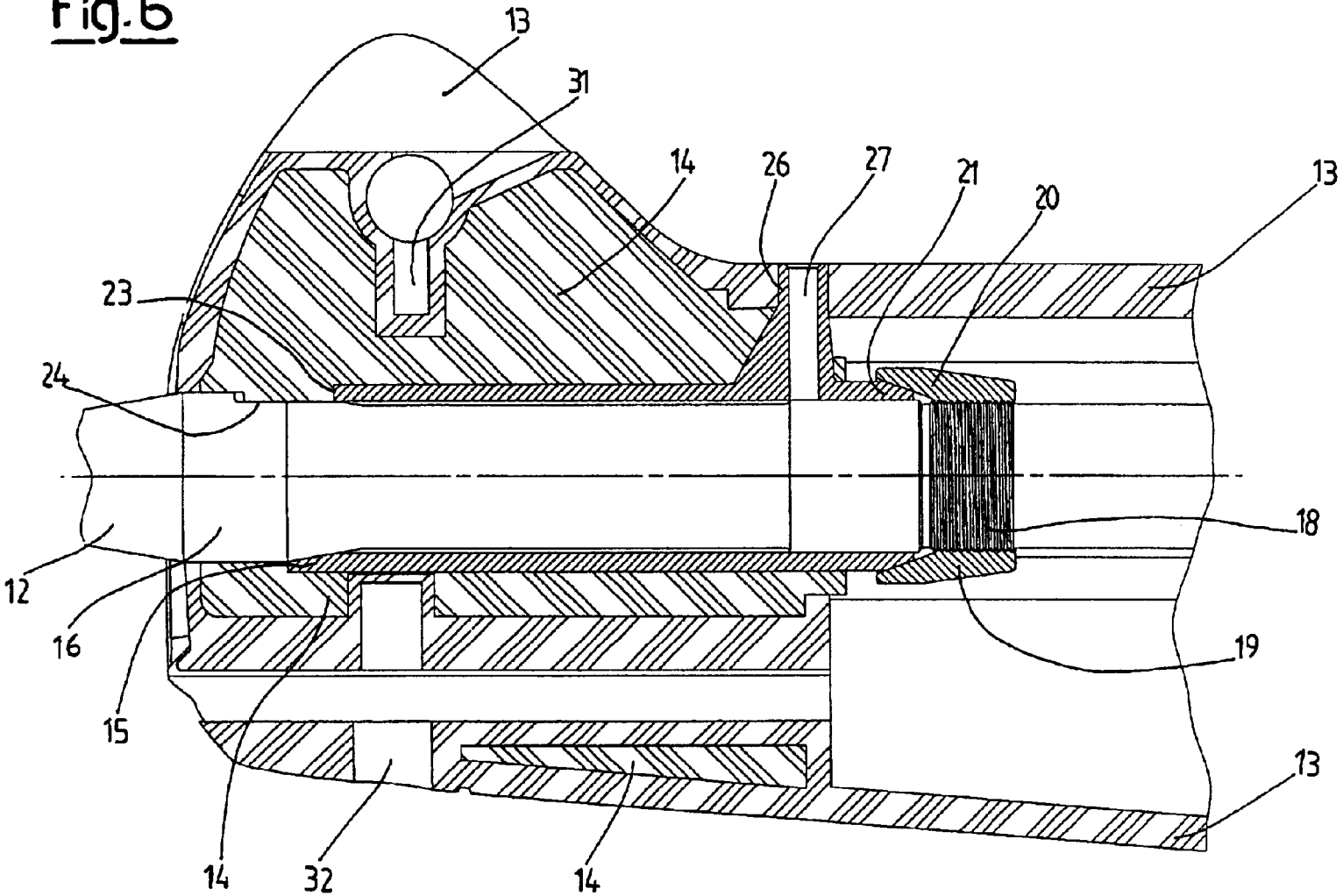
FIG. 6 is a partial section view of FIG. 5 according to the line VI—VI.

The ring nut 19 is equipped with an entry portion 20 with a frusto-conical inner surface for the positioning on a rear end 21 of the sleeve 15, tapered externally with a matching frusto-conical generatrix, according to that which is shown in the sections of FIGS. 5 and 6. At the opposite end, the sleeve 15 is equipped with an entry portion 22 with a frusto-conical inner surface for the axial positioning of the barrel 12 at the sleeve 15, which takes place in abutment on the ring 16.

The entry portion of the sleeve 22 is also equipped with a centring cut or milling 23, which defines the correct rotational positioning of the barrel on the sleeve, when coupling is carried out with a flattened portion 24 formed in the abutment ring 16 of the barrel 12 (FIGS. 5 and 6).

The sleeve also has side elements 25 protruding to form a bridge, and an upper projection 26, equipped with holes 27, for example threaded, which when the casing is mounted are situated at openings 28 of the inner element 14 and of the shell 13 and to which auxiliary devices (not shown) are applied, such as small metal plates or a support for the aiming device.

Figure 2:
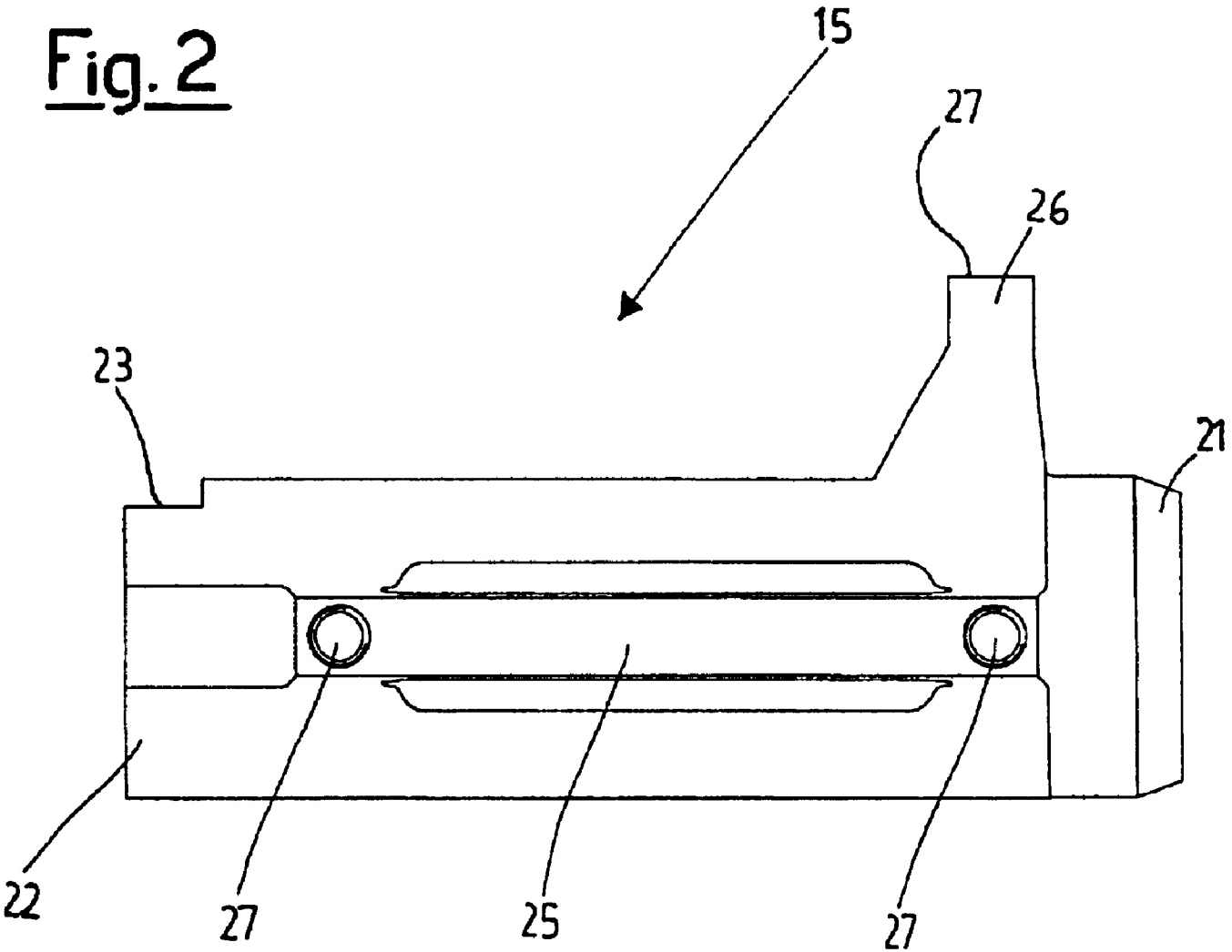
FIG. 2 is a side elevation view of a sleeve which establishes the attachment with the barrel.

The production method of the casing for firearms 10, object of the present invention, foresees the execution of successive overmouldings in sequence starting from the sleeve 15 shown in FIG. 2.

By overmoulding it is meant the moulding, according to the prior art, of structures made from polymeric material between two moulding shells in which the element is suitably positioned about which the overmoulding must be carried out.

Figure 3:
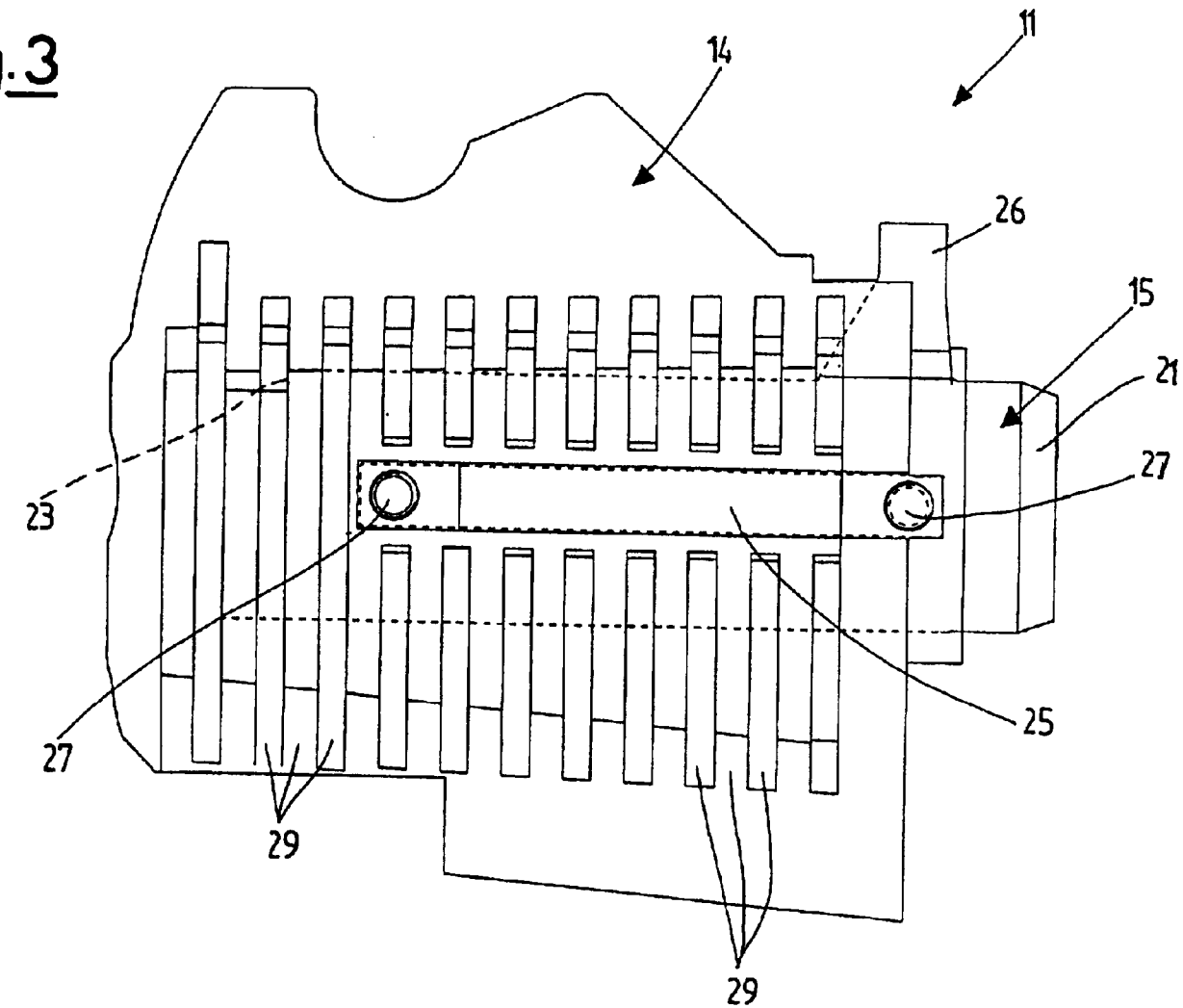
FIG. 3 is a side elevation view of a group consisting of sleeve and inner element moulded on the sleeve, partially indicated with a broken line.

On the sleeve 15 the inner element 14 is firstly moulded made from polymeric material equipped with excellent thermal and structural behaviour, for example a polymeric material loaded with glass fibres, in such a way forming the sleeve—inner element group 11 shown in FIG. 3.

Figure 4:
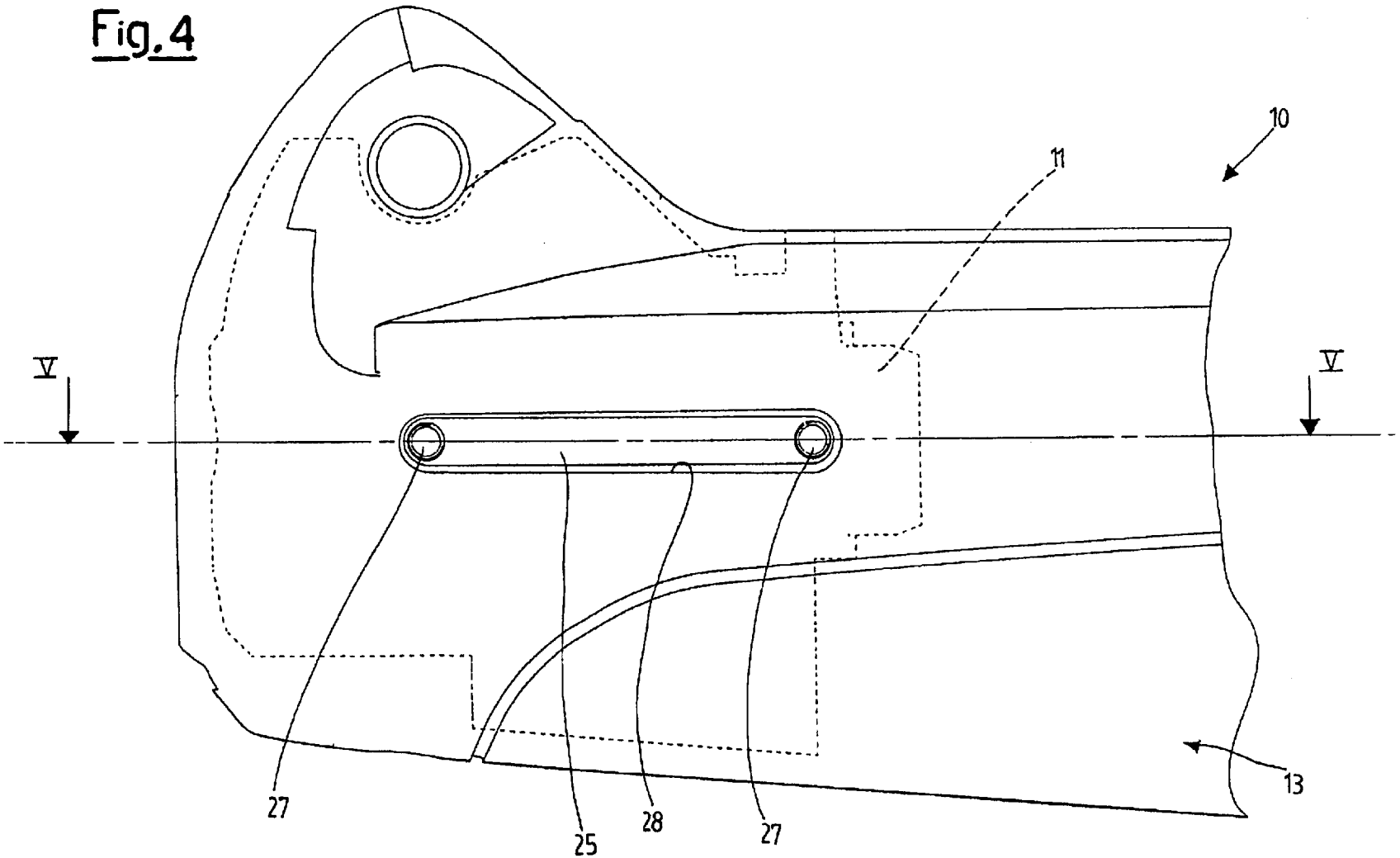
FIG. 4 is a side elevation view of the front portion of a finished casing, obtained through over-moulding of an outer shell on the group of FIG. 3, represented with a broken line.

The outer casing 13 made from polymeric material with lower density and worse thermal behaviour is then over-moulded on the group 11, to form the casing 10 (FIG. 4).

Finally, the barrel 12 is stably fixed to the casing 10, in a removable manner, through the threaded ring nut 19.

Indeed, the barrel 12 is inserted into the rear of the sleeve 15 until the correct axial and rotational positioning is reached in abutment against the ring 16. The locking of the threaded ring nut 19 on the frusto-conical tapered portion of the sleeve 21 ensures the stable self-centring locking of the barrel 12 to the sleeve 15 and therefore to the casing 10.

The inner element 14 is equipped, on side walls, with engagement elements, for example consisting of a plurality of ridges and throats 29, which when the outer shell 13 is overmoulded give rise to matching engagement elements of the shell 13, for example matching ridges and throats 29'. The provision of matching engagement elements offers a better anchoring surface with regard to roto-translational movements and ensures better heat dispersion between the inner element 14 and the shell 13.

Other anchoring points of the inner element 14 to the sleeve 15 consist of the upper projection 26, as well as the side bridge elements 25 of the sleeve 15, which enclose portions of material 30 of the inner element 14.

In the casing 10, according to the invention, the inner element 14 and the locking sleeve 15 of the barrel 12 constitute a single piece with the shell 13, being embedded into each other, and therefore cannot be dismounted.

The final shape of the inner element 14 substantially reproduces that of the shell 13, to avoid overmoulding portions of shell 13 of substantial thickness to realise the final shape of the casing 10.

Finally, the casing 10 according to the invention can, for example, have applied to it support and protection elements for auxiliary devices, such as the aiming shaft of the sight, engaged in an upper hole 31, and an attachment for a possible belt-carrying mesh in a lower hole 32.

The casing for firearms, object of the present invention, has the advantage of ensuring excellent thermal and mechanical resistance and of being shaped according to ergonomic shapes which may even be complicated.

The casing according to the invention is also advantageously equipped with extremely low weight.

The realisation of the casing through two successive overmoulding operations advantageously allows different materials to be used according to the specific requirements of resistance or of lightness.

Moreover, through the double overmoulding of structures which have a complex shape it is advantageously possible to avoid different shrinking of the material in areas of different thickness, which would determine substantial states of stress upon the material.

The casing for firearms thus conceived is susceptible to numerous modifications and variants, all of which are covered by the invention. Moreover, all of the details can be replaced with technically equivalent elements. In practice, the materials used, as well as the sizes, can be whatever according to the technical requirements.

I claim:

1. A casing for firearms which comprises a sleeve (15) on which is stably applied, through attachment means, a barrel (12), and inner element (14) which extends around said sleeve (15) is made from polymeric material which is adapted for the anchoring of said sleeve (15) and an outer shell (13) which is overmoulded on said inner element (14) and is made from polymeric material, said casing (10) being realized through successive overmouldings.

2. The casing according to claim 1, wherein said successive overmoulding comprise in sequence the overmoulding of said inner element (14) on said sleeve (15) to form a sleeve—inner element group (11) and then the overmoulding of said shell (13) on said group (11) to form said casing (10).

3. The casing according to claim 1, wherein said shell (13) is made from low density polymeric material.

4. The casing according to claim 1, wherein said inner element (14) is made from polymeric material with high thermal and structural resistance.

5. The casing according to claim 1, wherein said sleeve (15) is made from metal.

6. The casing according to claim 1, wherein said attachment means for the stable application of said barrel (12) to said sleeve (15) comprises an abutment ring (16) and a threaded portion (18), arranged externally on said barrel (12), and a threaded ring nut (19) for attachment to said sleeve (15) engaged on said threaded portion (18).

7. The casing according to claim 6, wherein said abutment ring (16) and said attachment ring nut (19) are respectively equipped with a guide slide (17) and with an entry portion (20) having frusto-conical generatrix, suitable for carrying out the axial positioning in said sleeve (15) which is equipped with matching ends (21, 22).

8. The casing according to claim 7, wherein said matching front and rear end entry portions (21, 22) of said sleeve (15) consist of a front entry portion (22) having an inner frusto-conical surface, and a rear end entry portion (21), which is tapered externally with a frusto-conical generatrix.

9. The casing according to claim 6, wherein an portion of said sleeve (15) is equipped with a milling (23), matching a flattened portion (24) of said abutment ring (16), for the rotational positioning of said barrel (12) on said sleeve (15).

10. The casing according to claim 1, wherein said sleeve (15) is equipped with protruding elements (25, 26) for anchoring in said inner element (14).

11. The casing according to claim 10, wherein said protruding elements (25, 26) are side elements (25) and an upper projection (26).

12. The casing according to claim 10 or 11, wherein said protruding element (25, 26) are side elements (25) which are equipped with holes (27) arranged at openings (28) of said inner element (14) and shell (13) for the application of auxiliary devices.

13. Casing according to claim 11, wherein said side elements (25) protrude to form a bridge and enclose portions of material (30) of said inner element (14).

14. The casing according to claim 1, wherein matching engagement elements which comprise a plurality of ridges and throats (29 and 29') are arranged on the outer side walls of said inner element (14) and on said inner walls of outer shell (13).

15. The casing according to claim 14, wherein said matching engagement elements are a plurality of matching ridges and throats (29 and 29').

* * * * *